US008453888B2

(12) United States Patent
Sommerfield et al.

(10) Patent No.: US 8,453,888 B2
(45) Date of Patent: Jun. 4, 2013

(54) WINE PRESERVATION AND DISPENSING APPARATUS

(75) Inventors: Matthew A. Sommerfield, Allentown, PA (US); Steven DiDonato, Harleysville, PA (US)

(73) Assignee: Wine Gadgets, LLC, Coopersburg, PA (US)

( * ) Notice: Subject to any disclaimer, the term of this patent is extended or adjusted under 35 U.S.C. 154(b) by 216 days.

(21) Appl. No.: 12/965,360

(22) Filed: Dec. 10, 2010

(65) Prior Publication Data

US 2011/0139828 A1 Jun. 16, 2011

Related U.S. Application Data

(60) Provisional application No. 61/285,382, filed on Dec. 10, 2009.

(51) Int. Cl.
*B65D 83/00* (2006.01)

(52) U.S. Cl.
USPC ..... 222/399; 222/129; 222/152; 222/394

(58) Field of Classification Search
USPC ..... 222/152, 129.1–129.4, 132, 136, 222/144.5, 146.6, 190, 399, 394, 396–397, 222/325, 129; 248/105, 107, 313, 309.1; 215/231, 269
See application file for complete search history.

(56) References Cited

U.S. PATENT DOCUMENTS

| | | | | |
|---|---|---|---|---|
| 1,843,532 | A | | 2/1932 | Willson |
| 2,723,041 | A | | 11/1955 | Hart-Still |
| 2,746,632 | A | | 5/1956 | Bramming |
| 2,757,816 | A | | 8/1956 | Fraser |
| 2,848,130 | A | | 8/1958 | Jesnig |
| 3,343,701 | A | | 9/1967 | Mahoney |
| 4,290,535 | A | | 9/1981 | Reina |
| 4,392,578 | A | | 7/1983 | Fipp et al. |
| 4,480,424 | A | | 11/1984 | Seldon |
| 4,482,072 | A | | 11/1984 | Hankins |
| 4,684,033 | A | | 8/1987 | Marcus |
| 4,706,847 | A | * | 11/1987 | Sankey et al. ..... 222/1 |
| 4,809,884 | A | | 3/1989 | Stackhouse |
| 5,172,821 | A | | 12/1992 | Knopf |
| 5,535,900 | A | | 7/1996 | Huang |
| 5,667,110 | A | | 9/1997 | McCann et al. |
| 7,051,901 | B2 | | 5/2006 | Hickert |
| 8,033,437 | B2 | * | 10/2011 | Haramiishi et al. ..... 227/120 |
| 2011/0000250 | A1 | * | 1/2011 | Sommerfield et al. ..... 62/391 |

* cited by examiner

*Primary Examiner* — Frederick C. Nicolas

(74) *Attorney, Agent, or Firm* — Welsh Flaxman & Gitler LLC

(57) ABSTRACT

A dispensing apparatus includes a housing having a support platform upon which at least one bottle may be supported and a pressurized gas supply assembly for forcing a fluid from the at least one bottle. The pressurized gas supply assembly includes an inert gas output which is linked to the at least one bottle via a conduit arrangement and a dispensing nozzle selectively secured within an opening of the at least one bottle. The dispensing nozzle includes a connecting seal assembly for attaching the dispensing nozzle within the opening of the at least one bottle, the connecting seal assembly extends downwardly and substantially covers a downwardly extending substrate of the dispensing nozzle, and the connecting seal assembly includes a self-energizing seal.

5 Claims, 8 Drawing Sheets

FIG. 4
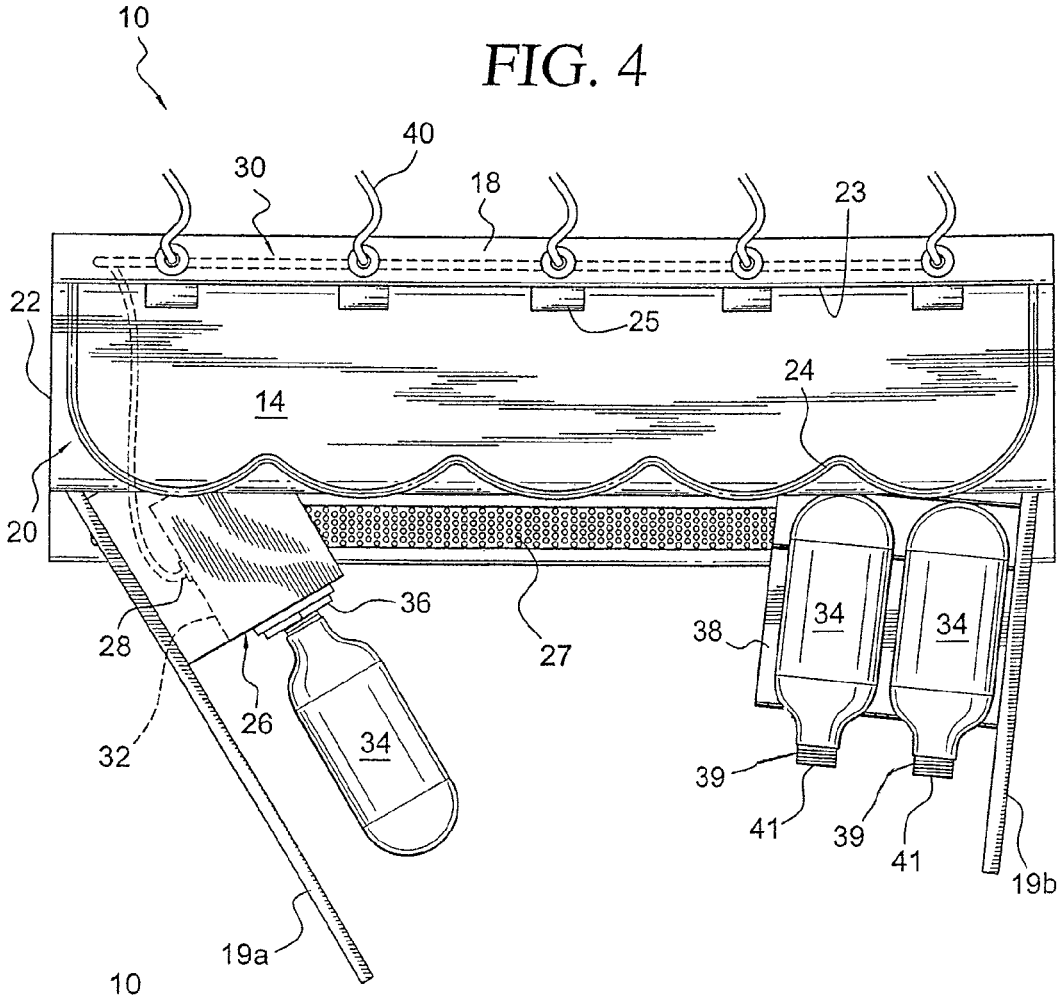
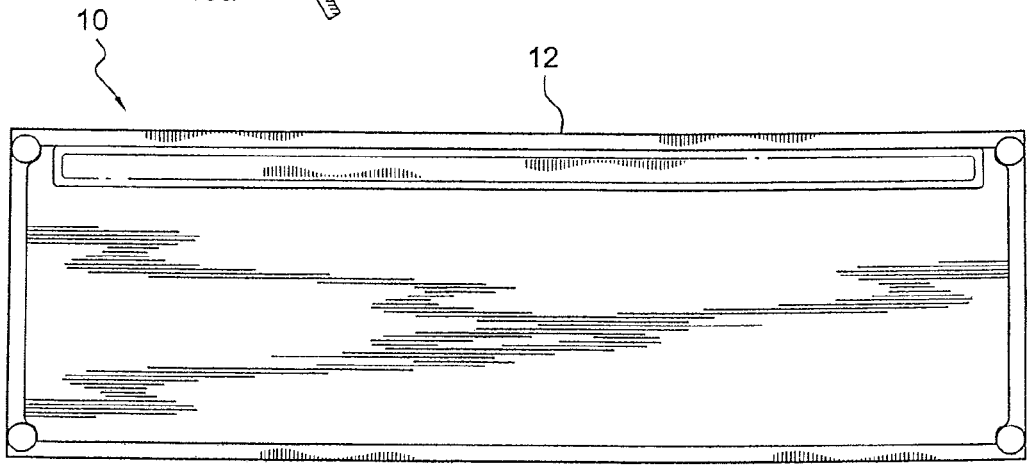
FIG. 6

WINE PRESERVATION AND DISPENSING APPARATUS

CROSS REFERENCE TO RELATED APPLICATION

This application claims the benefit of U.S. Provisional Patent Application Ser. No. 61/285,382, entitled "WINE PRESERVATION AND DISPENSING APPARATUS", filed Dec. 10, 2009.

BACKGROUND OF THE INVENTION

1. Field of the Invention

The invention relates to a wine preservation and dispensing apparatus. More particularly, the invention relates to a seal assembly for a dispensing nozzle.

2. Description of the Related Art

Wine is a very popular beverage, and its popularity within the United States has recently increased substantially. Most wine is distributed to consumers in bottles that are sealed with a cork to prevent exposure to the air and to preserve the wine. Since removal of the cork exposes the wine to air and ultimately oxidation of the wine, wine will begin to degrade as soon as the wine bottle is open. As such, many people will only drink wine when they are drinking an entire bottle. In addition, many restaurants and bars require most wines to be bought by the bottle and offer a limited number of wine choices for those wishing to purchase only a single glass of wine.

More particularly, those skilled in the art will appreciate that from the instant one opens a bottle of wine the air begins to affect the character of the wine. This is a process known as oxidation and is readily recognizable. While it is widely held that allowing the wine to "breathe" is beneficial, it is the opinion of many people excessive exposure to air can negatively affect the wine's taste. In fact, it is understood oxidation can begin to break down the character of a young, red wine in as little as six hours, while white wines and older red wines may begin to suffer in only two hours. This means some wine drinkers will be able to notice a reduction in the aromatic qualities of the wine, a negative change in the color of the wine and flat, stale and/or lifeless taste in the wine.

With the foregoing in mind, attempts have been made to reduce the oxidation and degradation of wine once a wine bottle is opened. While these attempts have achieved some success, a need continues to exist for a system which will provide for the preservation and dispensing of wine in a manner allowing an individual to only drink a single glass of wine and save the remainder for a later time or allow a restaurant to serve wine by the glass without worrying the wine sold later to another consumer is of a lower quality than the wine when it was initially opened.

The present invention addresses these problems by providing a wine preservation and dispensing system which may be utilized by either a restaurant/bar or a home consumer. More particularly, the present invention provides a seal assembly allowing the wine preservation and dispensing system to operate in a highly efficient manner.

SUMMARY OF THE INVENTION

It is, therefore, an object of the present invention to provide a dispensing apparatus including a housing having a support platform upon which at least one bottle may be supported and a pressurized gas supply assembly for forcing a fluid from the at least one bottle. The pressurized gas supply assembly includes an inert gas output which is linked to the at least one bottle via a conduit arrangement and a dispensing nozzle selectively secured within an opening of the at least one bottle. The dispensing nozzle includes a connecting seal assembly for attaching the dispensing nozzle within the opening of the at least one bottle. The connecting seal assembly extends downwardly and substantially covers a downwardly extending substrate of the dispensing nozzle, and the connecting seal assembly includes a self-energizing seal.

It is also an object of the present invention to provide a dispensing apparatus wherein the self-energizing seal is cylindrical and includes an outer wall shaped and dimensioned to engage an inner wall of the opening of the at least one bottle.

It is a further object of the present invention to provide a dispensing apparatus wherein the self-energizing seal also includes an inner wall having a central portion which is spaced from an outer surface of the downwardly extending substrate of the dispensing nozzle and defines, in conjunction with the outer surface of the downwardly extending substrate of the dispensing nozzle, a cavity which is in communication with the pressurized gas supply assembly for expanding the self-energizing seal and forcing it into contact with an inner wall of the opening of the at least one bottle.

It is another object of the present invention to provide a dispensing apparatus wherein an aperture is formed in the downwardly extending substrate of the dispensing nozzle allowing for free flow of gas therethrough.

It is also an object of the present invention to provide a dispensing apparatus wherein a compression coupling member secures the self-energizing seal in position about the downwardly extending substrate of the dispensing nozzle.

It is a further object of the present invention to provide a dispensing apparatus wherein the downwardly extending substrate includes a retaining recess shaped and dimensioned for receiving an inwardly directed flange at a first end of the self-energizing seal.

It is also an object of the present invention to provide a dispensing apparatus wherein the self-energizing seal includes the first end positioned adjacent a first end of the downwardly extending substrate and a second end positioned adjacent a second end of the downwardly extending substrate. The self-energizing seal further including a circumferential, lower retaining wall adjacent the first end of the self-energizing seal and a circumferential, upper retaining wall adjacent the second end of the self-energizing seal with a plurality of hollow outwardly extending ribs extending therebetween.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 4 is a top plan view of the apparatus shown in FIG. 1 with the storage compartment doors open.

FIG. 6 is a bottom plan view of the apparatus shown in FIG. 1.

DESCRIPTION OF THE PREFERRED EMBODIMENT

Figure 1:
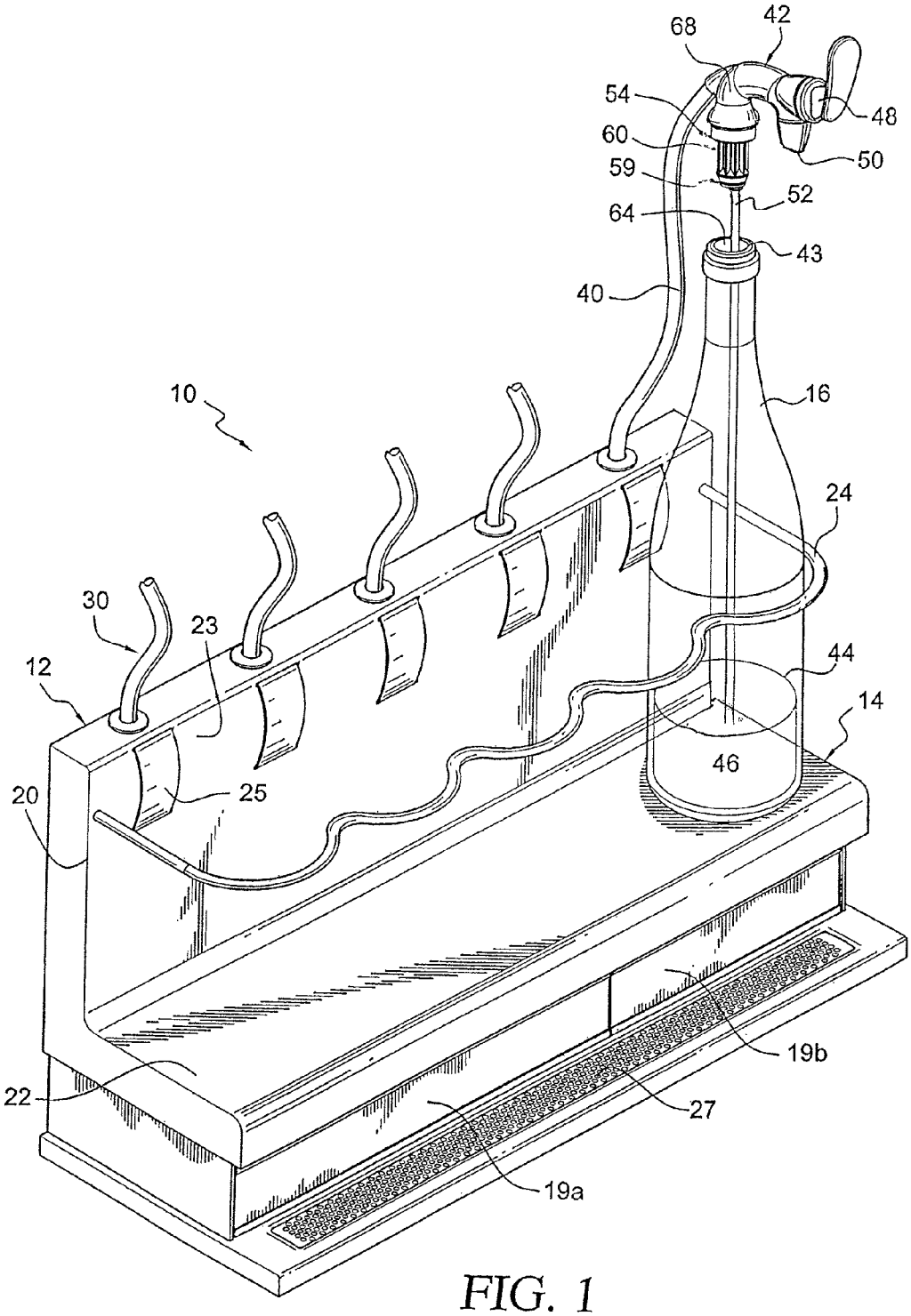
FIG. 1 is a perspective view of the preservation and dispensing apparatus in accordance with the present invention.
Figure 2:
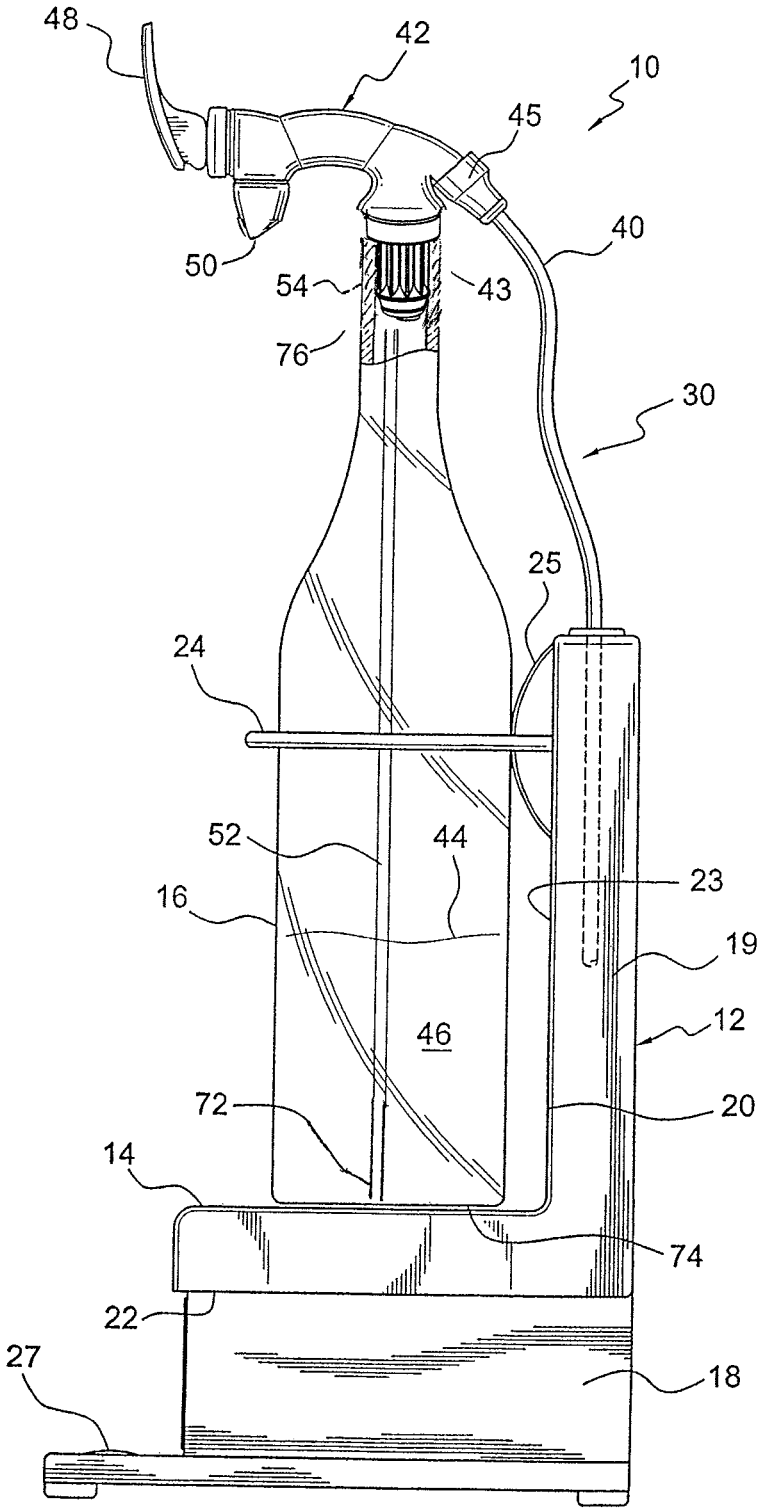
FIG. 2 is side view of the apparatus shown in FIG. 1.
Figure 3:
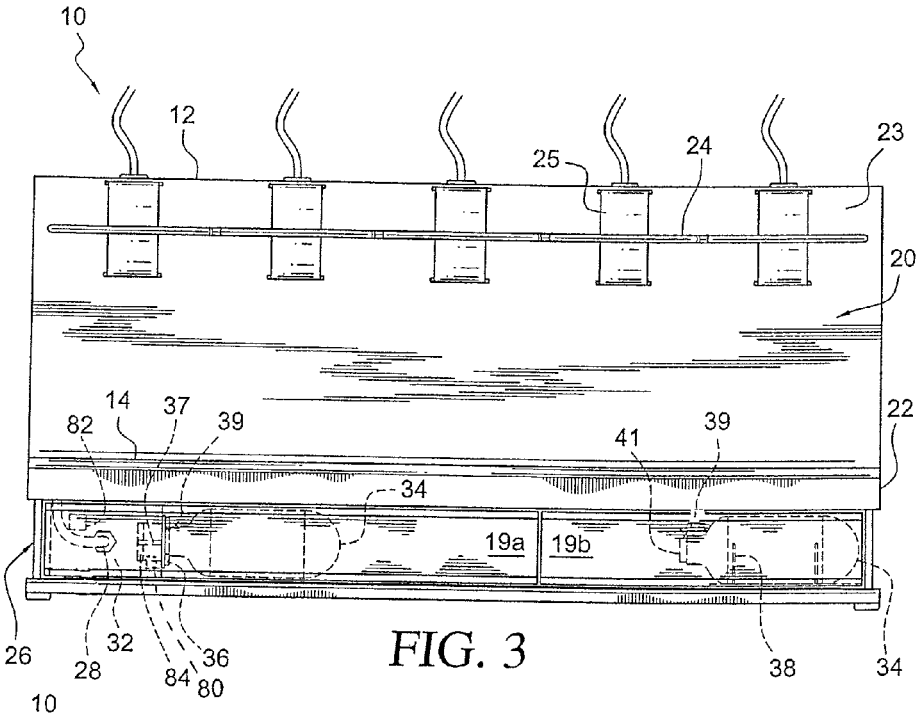
FIG. 3 is a front plan view of the apparatus shown in FIG. 1.
Figure 5:
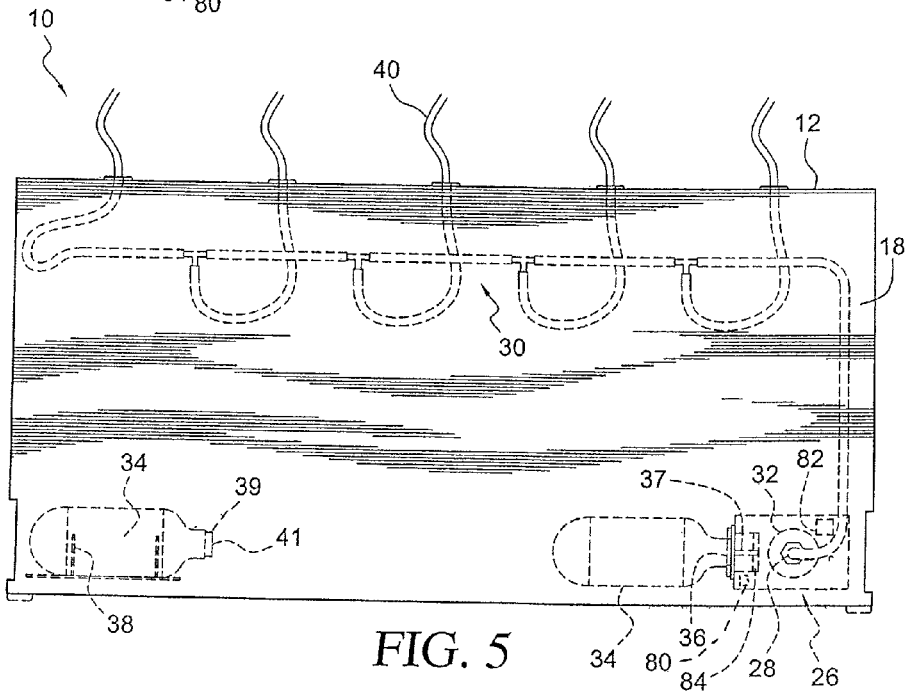
FIG. 5 is a rear plan view of the apparatus shown in FIG. 1.
Figure 7:
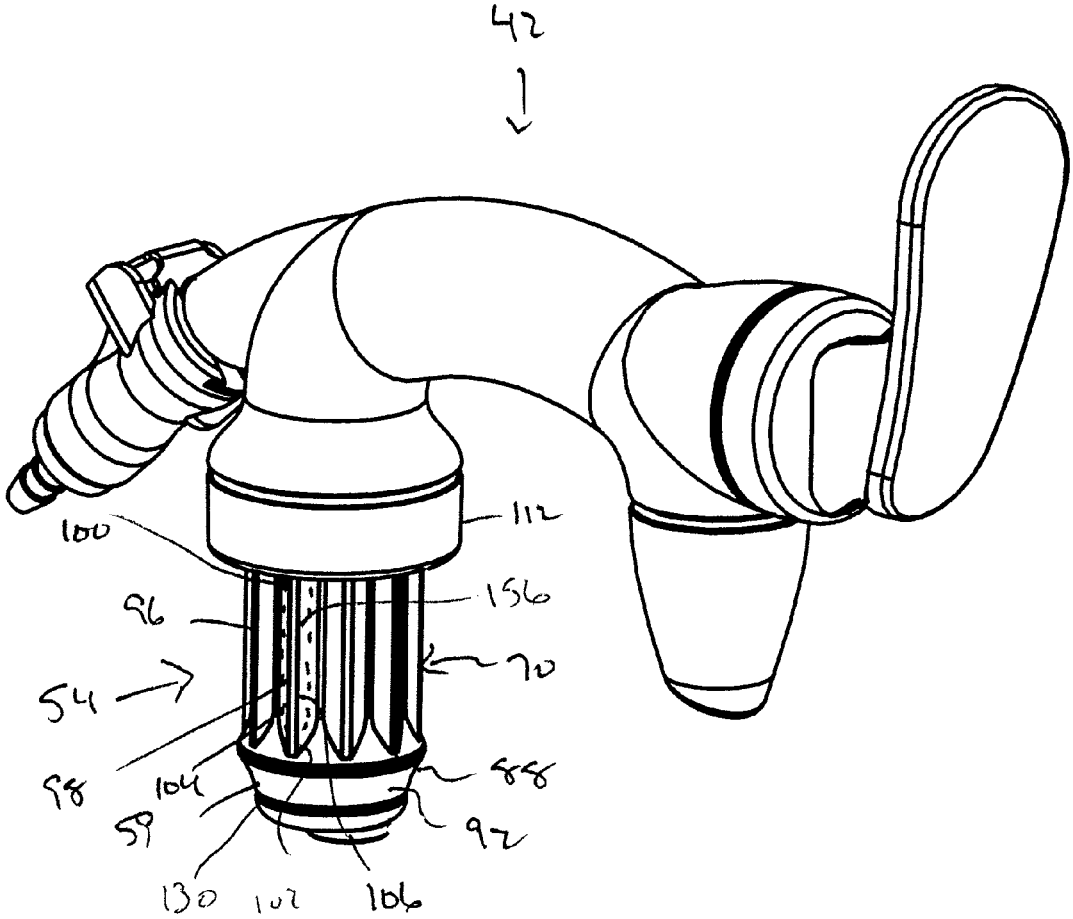
FIG. 7 is a detailed perspective view of the dispensing nozzle in accordance with the present invention.
Figure 8:
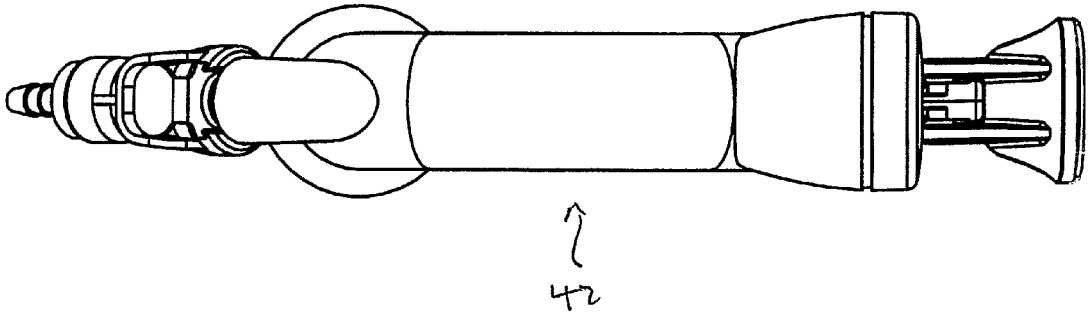
FIG. 8 is a top view of the dispensing nozzle shown in FIG. 7.
Figure 9:
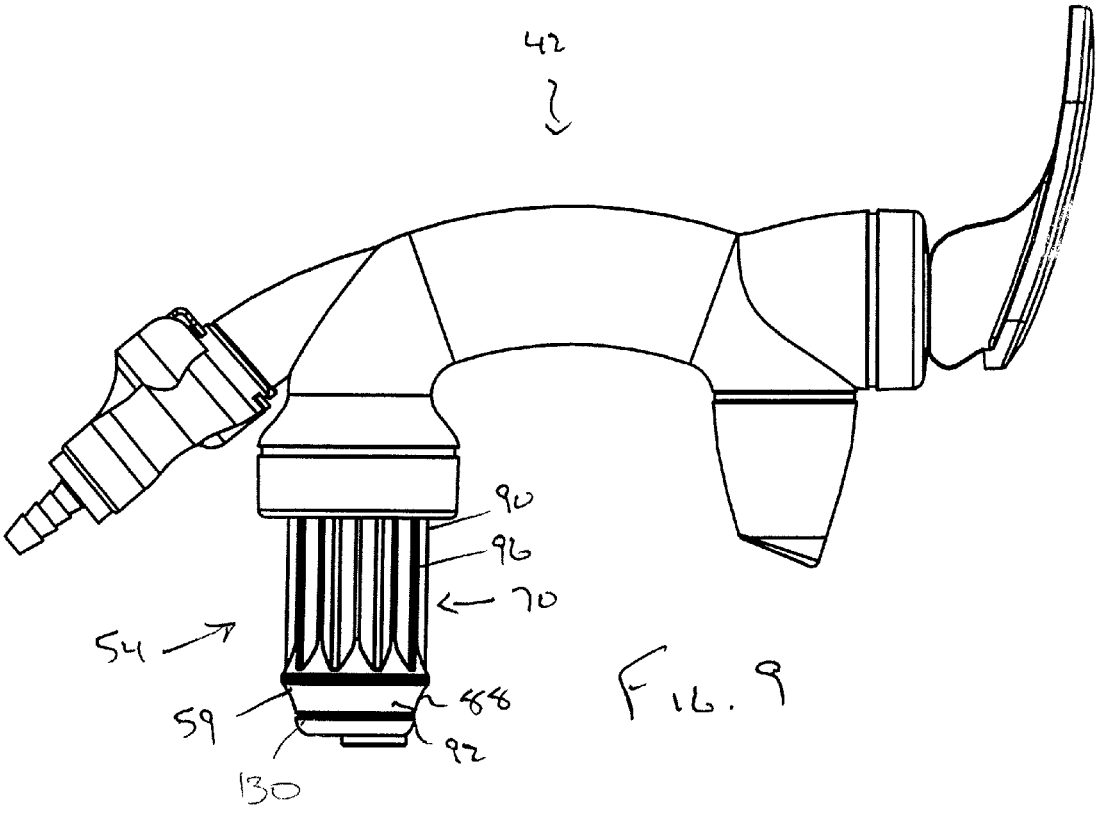
FIG. 9 is a side view of the dispensing nozzle shown in FIG. 7.
Figure 10:
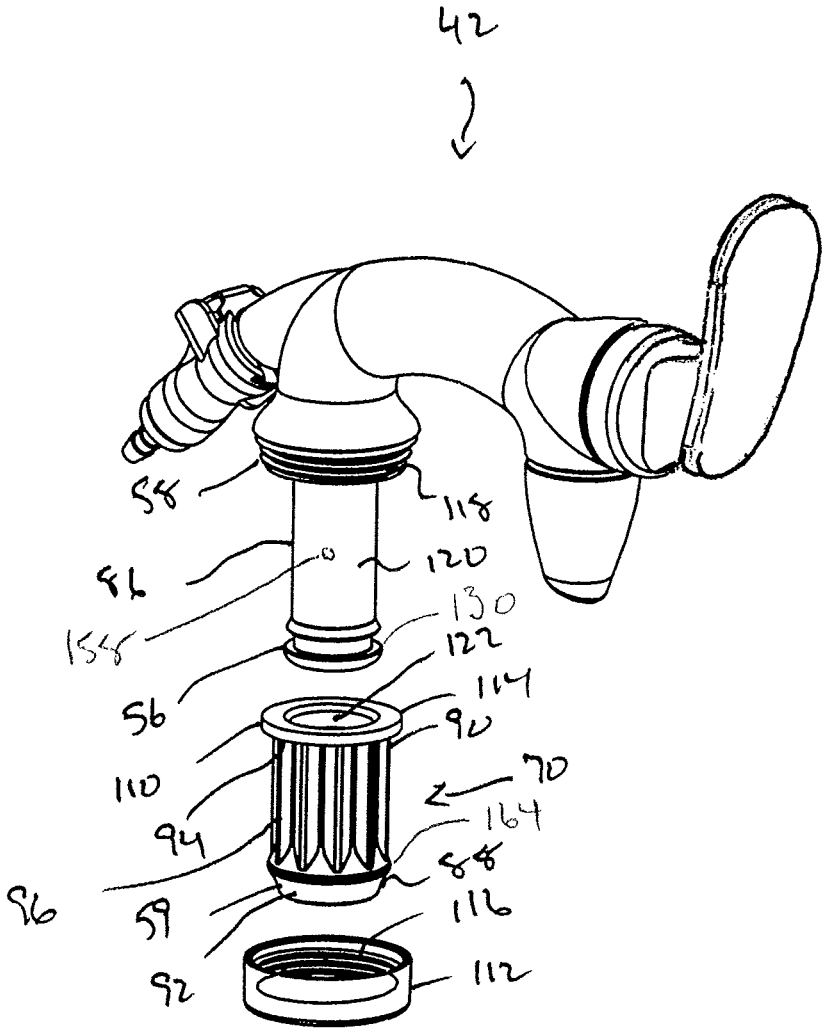
FIG. 10 is an exploded view of the dispensing nozzle shown in FIG. 7.
Figure 11:
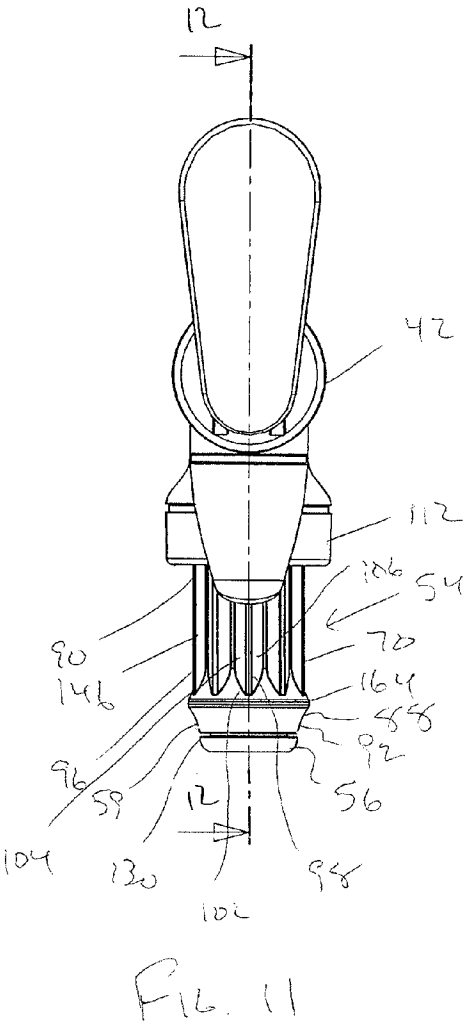
FIG. 11 is a front view of the dispensing nozzle shown in FIG. 7.
Figure 12:
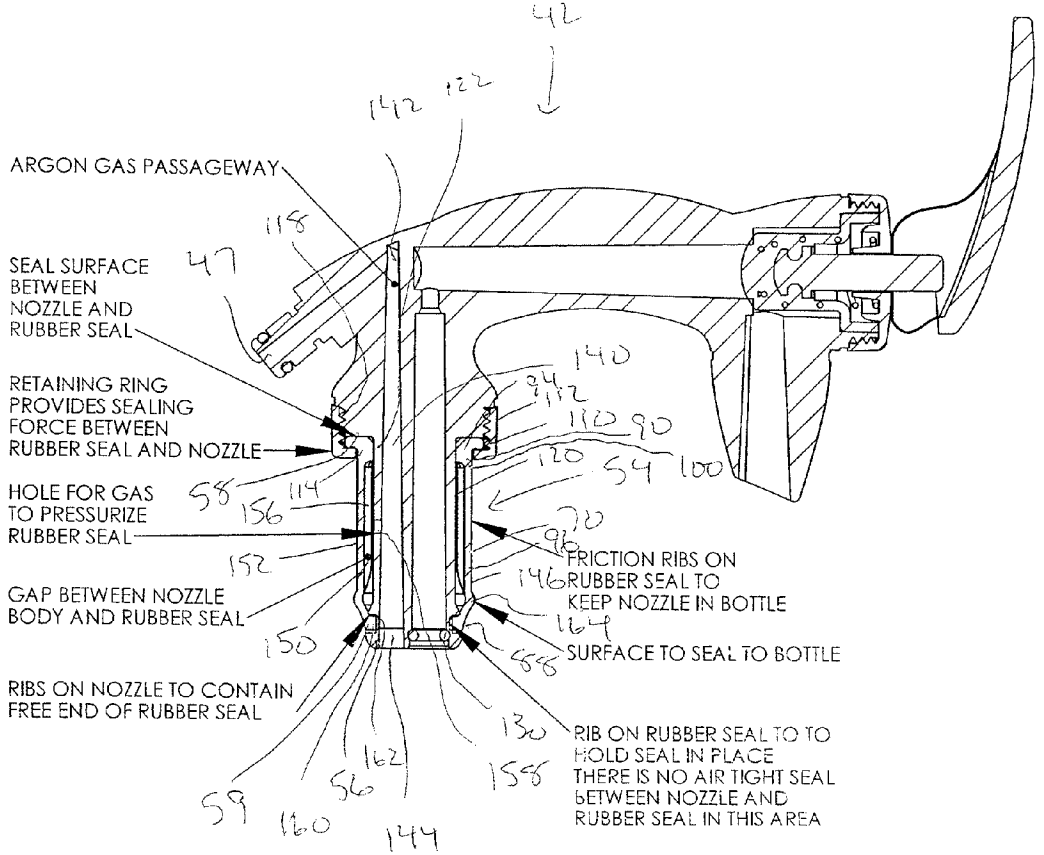
FIG. 12 is a cross sectional view along the line 12-12 shown in FIG. 11.

The detailed embodiment of the present invention is disclosed herein. It should be understood, however, that the disclosed embodiment is merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to the various figures, a preservation and dispensing apparatus 10 is disclosed. Although the present preservation and dispensing apparatus 10 is disclosed in accordance with a preferred embodiment for use in conjunction with the preservation and dispensing of wine, the present apparatus 10 may be used for the dispensing of other liquid products without departing from the spirit of the present invention. As the following disclosure will reveal, the present apparatus 10 is portable and provides a self-contained apparatus that may be conveniently installed and/or removed without connection to any remote gas sources.

Many restaurants have learned that it is highly desirable, and profitable, to offer consumers wine by the glass as opposed to requiring consumers to purchase a full bottle of the wine. However, with this service comes the problem of preserving the wine remaining in a bottle after a consumer has ordered a single glass and before the bottle is finished by others ordering the same wine. With this in mind, the present wine preservation and dispensing apparatus 10 has been developed. It will be appreciated by those skilled in the art that, although a preferred embodiment disclosed herein shows an apparatus suitable for holding five bottles of wine, the present apparatus may readily be adapted for use with more or less dispensing stations without departing from the spirit of the present invention.

The apparatus 10 includes a housing 12 having a support platform 14 upon which multiple wine bottles 16 are supported, a bottom storage compartment 18 in which the underlying working components are stored and hidden from view and a rear cavity 19 in which the tubes bringing gas to the wine bottles 16 are hidden from view. More particularly, the support platform 14 is composed of a container or bottle support assembly 20 including a base 22, a rear wall 23 and a retaining member 24. The base 22, rear wall 23 and retaining member 24 are shaped and dimensioned to support wine bottles 16 in an upright configuration for ease of use and ready replacement of the wine bottles 16. Spring members 25 are provided on the rear wall 23 to assist in securely supporting the wine bottles 16. The spring members 25 are convex leaf springs facing outwardly such that they engage wine bottles 16 to push them away from the rear wall 23 and toward the retaining member 24. While metal leaf springs are contemplated for use in accordance with a preferred embodiment of the present invention, those skilled in the art will appreciate a variety of known materials, for example, plastics, may be used without departing from the spirit of the present invention. This creates a frictional engagement between the spring member 25, the retaining member 24 and the wine bottle 16 to securely hold the wine bottle 16 to the bottom support assembly 20. In accordance with a preferred embodiment of the present invention, a drip pan 27 is also positioned beneath the base 22 to catch any wine that may drip from the dispensing nozzle 42 during use thereof.

The apparatus 10 also includes a pressurized gas supply assembly 26. As will be discussed below in greater detail, the pressurized gas supply assembly 26 provides the necessary pressure for forcing wine 46 from the wine bottles 16 through the dispensing nozzle 42. The pressurized gas supply assembly 26 also provides a mechanism for pressurizing the wine 46 through the utilization of argon gas in a manner that effectively creates a barrier protecting the wine 46 from the harmful effects of oxygen. Argon gas is inert and stable, and many times denser than nitrogen. For these reasons, it is far superior as a wine preservative. It envelops the wine 46 and keeps out the harmful effects of oxidation. In fact, many high caliber wine producers use argon to replace the negative, degenerate qualities of oxygen in their wine making.

The pressurized gas supply assembly 26 includes an inert gas output 28 which is linked to the various wine bottles 16 via a conduit arrangement 30 composed of flexible tubing and a dispensing nozzle 42 selectively secured to, that is, within, the openings 43 of the wine bottles 16. In particular, inert gas output 28 includes a regulator assembly 32 to which an argon gas capsule 34 is selectively secured via a threaded coupling arrangement 36 for supplying argon gas in accordance with the present invention. The threaded coupling arrangement 36 includes a piercing pin 37 shaped and dimensioned to puncture the sealed coupling end 39 of a new gas capsule 34 as it is secured to the regulator assembly 32. In particular, a new gas capsule 34 will have a sealed coupling end 39 with external threading shaped and dimensioned to mate with the threading of the threaded coupling arrangement 36 and an end cap 41 shaped and dimensioned for penetration by the piercing pin 37. As the gas capsule 34 is secured to the regulator assembly 32, the piercing pin 37 passes through the end cap 41 of the gas capsule 34 allowing gas from the gas capsule 34 to pass through the piercing pin 37 and the remainder of the regulator assembly 32, and to the various wine bottles 16 connected to the apparatus 10 in accordance with the present invention. A tight seal between the threaded coupling arrangement 36 and the gas capsule 34 is ensured by the placement of a rubber gasket 84 between the gas capsule 34 and the body of the threaded coupling arrangement 36.

The regulator assembly 32 allows for the utilization of argon gas maintained at high pressure, but which may be shipped in non-hazardous containers of less than four (4) fluid ounces. In particular, the regulator assembly 32 is able to reduce the pressure of the argon gas as maintained within the gas capsule 34 from 2700 psi to 5 psi for use in accordance with the present invention.

The regulator assembly 32 used in accordance with the present invention provides for enhanced performance and improved safety. In accordance with a preferred embodiment, the regulator assembly is manufactured by Leland Gas Technologies and is sold as Model No. 50043 of the NR 30 fixed series. In particular, by providing a pressure drop from 2700 psi to 5 psi in a single step, the argon gas is transferred from the gas capsule 34 at a useful pressure without the need for a multiple step pressure reduction. This improves the efficiency in applying gas pressure to the wine and allows for a relatively compact system which may be readily installed and used in a wide variety of locations.

As to safety issues, the regulator assembly 32 is provided with a dump valve 80 which monitors coupling of the gas capsule 34 to the threaded coupling arrangement 36 of the regulator assembly 32 and releases pressure within the system in the event it senses a full or partially filled gas capsule 34 is being removed from the threaded coupling arrangement 36 since the force of the gas escaping the gas capsule 34 might cause substantial damage. The regulator assembly 32 also includes a burst prevention system 82 composed of a rupture disk that will release pressure in the event undesirable high pressure is identified as coming from the gas capsule 34.

As those skilled in the art will appreciate, an argon gas capsule 34 will only hold a limited amount of argon gas and replacement capsules will be consequently required. As such, the bottom storage compartment 18 of the present apparatus 10 is provided with a capsule support 38 for storing multiple replacement argon gas capsules such that when one is used up, the operator of the present apparatus 10 may readily retrieve an additional capsule and replace the used capsule.

Access to the bottom storage compartment 18 in which the gas capsules 34 and the regulator assembly 32 are found is achieved by providing the bottom storage compartment 18 with doors 19*a*, 19*b* that pivotally open to reveal the working components and allow for ready access. In fact, access is further improved by securing the valve and regulator assembly 32 to one of the doors 19*a* such that it pivots outwardly in a manner openly revealing the regulator assembly 32 and the gas capsule 34 secured thereto.

As discussed above, the argon gas capsule 34 is linked to the various wine bottles 16 via a conduit arrangement 30. The conduit arrangement 30 is composed of various tubes 40 connected to respective dispensing nozzles 42. More particularly, connection members 45 at the ends of the tubes 40 are secured to gas inlets 47 of the dispensing nozzles 42. In accordance with a preferred embodiment, the connection members are quick disconnect assemblies well known to those skilled in the art. The dispensing nozzles 42 are selectively secured within the openings 43 of wine bottles 16.

In particular, and with reference to the first wine bottle 16 as shown in FIG. 1 and as disclosed in commonly owned U.S. patent application Ser. No. 11/797,681, entitled "Wine Preservation and System", which is incorporated herein by reference, the pressurized argon gas enters the pressurized gas supply assembly 26 and runs through the conduit arrangement 30 into a conduit 140 passing through the dispensing nozzle 42 where it exits the dispensing nozzle 42 and is exposed to the upper surface 44 of the wine 46 and fills in any open space within the wine bottle 16 in a manner preventing the wine 46 from coming in contact with oxygen which would otherwise harm the quality of the wine 46. When the spring biased valve 48 at the dispensing end 50 of the dispensing nozzle 42 is actuated to open the passageway from the wine bottle 16 to the dispensing end 50 of the dispensing nozzle 42, the pressure of the argon gas forces the wine 46 upwardly through the draw tube 52 and out the dispensing end 50 of the dispensing nozzle 42 for collection within a wine glass. Since it is the argon gas that is pushing the wine 46 out, the argon gas fills the space created by the dispensing of the wine 46.

As those skilled in the art will certainly appreciate, it is very important that the free first end 72 of the draw tube 52 be positioned at the bottom 74 of the wine bottle 16 so that all of the wine may be dispensed in accordance with the present invention. With this in mind, the second end 76 of the draw tube 52 is mounted within the outlet lumen 78 (via a seal member 79) of the dispensing nozzle 42 in a manner permitting the draw tube 52 to telescopically move within the outlet lumen 78 of the dispensing nozzle 42.

As those skilled in the art will certainly appreciate, argon gas is very effective at preserving the wine 46. As such, it is critical that the present apparatus 10 provide for a closed system and that the dispensing nozzle 42 be securely mounted within the opening 43 of the wine bottle 16. Since the openings 43 of wine bottles 16 come in various shapes and often are not perfect circles, a connecting seal assembly 54 for attaching the dispensing nozzle 42 within the opening 43 of the wine bottle 16 must be adapted to accommodate various wine bottles 16 without allowing leakage of either oxygen into the wine bottle 16 or argon out of the wine bottle 16.

With reference to FIGS. 7, 8, 9, 10, 11 and 12, the dispensing nozzle 42 includes a downwardly extending substrate 86 to which the connecting seal assembly 54 is secured. The conduit 140 feeding pressurized argon gas from the pressurized gas supply assembly 26 through the dispensing nozzle 42 and into contact with the upper surface 44 of the wine 46 contained within the wine bottle 16 extends through the substrate 86. In particular, the conduit 140 defines a passageway for the argon gas as it is transmitted from the gas inlet 47 of the dispensing nozzle 42 to the upper surface 44 of the wine 46 contained within the wine bottle 16. As such, the conduit 140 includes a first end 142 in fluid communication with the gas inlet 47 and a second end 144 in fluid communication with the interior of the wine bottle 16.

The connecting seal assembly 54 extends downwardly, and substantially covers the downwardly extending substrate 86, for insertion within the bottle opening 43. The downwardly extending substrate 86 includes a first end 56 and a second end 58. The first end 56 is positioned adjacent the free end 59 of the connecting seal assembly 54. The second end 58 of the downwardly extending substrate 86 is positioned adjacent the upper edge 110 of the connecting seal assembly 54.

Between the free end 59 and the upper edge 110 of the connecting seal assembly 54 is a self-energizing seal 70. That is, the connecting seal assembly 54 includes a self-energizing seal 70 between its free end 59 and its upper edge 110. The self-energizing seal 70 is positioned over and supported by the downwardly extending substrate 86. The self-energizing seal 70 is cylindrical and includes an outer wall 146 shaped and dimensioned to engage the inner wall 64 of the bottle opening 43 as discussed below in greater detail. The self-energizing seal 70 also includes an inner wall 150 having a central portion 152 which is spaced from the outer surface 120 of the substrate 86 and defines, in conjunction with the outer surface 120 of the substrate 86, a cavity 156 which is in fluid communication with the conduit 140 extending through the substrate 86 via an aperture 158 formed in the substrate 86 allowing for the free flow of gas therethrough. As such, and as will be discussed below in greater detail, when the argon gas is applied to the wine bottle 16 through the dispensing nozzle 42, pressurized argon gas passing through the conduit 140 on its way to the interior of the wine bottle 16 is forced into the cavity 156 defined by the self-energizing seal 70 to expand the self-energizing seal 70 and force it into contact with the inner wall 64 of the bottle opening 43.

The self-energizing seal 70 is secured in its position about the downwardly extending substrate 86 via a compression coupling member 112. The compression coupling member 112 holds a flange 114 along the upper edge 110 of the connecting seal assembly 54 adjacent the second end 58 of the downwardly extending substrate 86 by securely attaching threading 116 on the compression coupling member 112 with threading 118 on the second end 58 of the downwardly extending substrate 86 such that the flange 114 of the self-energizing seal 70 is held between the compression coupling member 112 and the second end 58 of the substrate 86.

With this attachment mechanism in mind, the inner diameter of the connecting seal assembly 54 is only slightly larger than the outer diameter of the downwardly extending substrate 86 such that the inner surface 122 of the connecting seal assembly 54 contacts the outer surface 120 of the downwardly extending substrate 86 creating a clamp force holding the self-energizing seal 70 upon the downwardly extending substrate 86. The pressurized argon gas forced within the cavity 156 defined between the self-energizing seal 70 and the substrate 86 needs to be contained so the seal created at the upper edge 110 of the connecting seal assembly 54 is maintained for preventing the escape of gas from the cavity 156. The compression coupling member 112 provides a clamp force to create a seal between the upper edge 110 of the connecting seal assembly 54 and the substrate 86 of the body of the dispensing nozzle 42.

A secure seal between the self-energizing seal 70 and the substrate 86 is further achieved by the provision of a retaining recess 130 along the first end 56 of the substrate 86 which is shaped and dimensioned for receiving an inwardly directed flange 160 at the first end 88 of the self-energizing seal 70 so as to securely seat and hold the self-energizing seal 70 in position along the first end 56 of the substrate 86. The retaining recess 130 is a circular recess 162 formed in the substrate 86 which is shaped and dimensioned to extend slightly into the outer surface 120 of the substrate 86 such that the inwardly directed flange 160 at the first end 88 of the self-energizing seal 70 may seat therein and is secured in place with the first end 88 of the self energizing seal 70 with respect to the substrate 86. It should be appreciated that the bottom edge, that is, the first end 88 of the self-energizing seal 70 does not need to be fixedly sealed to the substrate 86 since the outward pressure generated as the argon gas fills the cavity 156 between the self-energizing seal 70 and the substrate 86 and the inward pressure coming from the argon gas forced into the wine bottle 16 are equal and counteract each other.

The present use of the compression coupling member 112 and the retaining recess ring 130 allow for easy removal of the self-energizing seal 70 for cleaning and/or replacement. This is achieved by detaching the compression coupling member 112 which allows the self-energizing seal 70 to be slid off the substrate 86 and over the retaining recess ring 130. The self-energizing seal 70 is reattached by simply reversing the process.

In accordance with a preferred embodiment, the self-energizing seal 70 is composed of silicone rubber, although other equivalent materials may be used without departing from the spirit of the present invention. The material chosen for the construction of the self-energizing seal 70 provides for the flexibility of the self-energizing seal as discussed below in greater detail.

The self-energizing seal 70 includes a first, or lower, end 88 positioned adjacent the first end 56 of the downwardly extending substrate 86 and a second, or upper, end 90 positioned adjacent the second end 58 of the downwardly extending substrate 86. The self-energizing seal 70 is composed of a circumferential, lower retaining wall 92 adjacent the lower end 88 of the self-energizing seal 70 and a circumferential, upper retaining wall 94 adjacent the upper end 90 with a plurality of hollow outwardly extending ribs 96 extending therebetween.

Adjacent the lower retaining wall 92 along the first, or lower, end 88 of the self-energizing seal 70 is an outwardly directed sealing ring 164 which forms the primary sealing surface between the self-energizing seal 70 and the inner wall 64 of the bottle opening 43. Since the self-energizing seal 70 is not a closed system and will not inflate on its own, the primary sealing surface, that is, the outwardly directed sealing ring 164, must make contact with the inner wall 64 of the bottle opening 43 and close the system between the argon gas inlet 47 and the wine bottle 16 prior to connecting to the gas supply in order for the system to work properly by filling the cavity 156 between the self-energizing seal 70 and the substrate 86 so as to apply pressure to the inner wall 64 of the bottle opening 43.

The ribs 96 formed between the upper retaining wall 92 and the lower retaining wall 94 expand outwardly under the pressure of the argon gas contained in the cavity 156 to provide for controlled outward expansion of the ribs 96 in a manner helping to seal the internal compartment of the wine bottle 16 from the external environment by frictionally engaging the inner wall 64 of the bottle opening 43 to ensure that the sealing ring 164 prevents the escape of gas from the interior of the wine bottle. As with the upper and lower retaining walls 94, 92, the plurality of outwardly extending ribs 96 extend about the circumference of the self-energizing seal 70 creating a complete seal about the inner wall 64 of the opening 43 along the bottle neck.

Each of the ribs 96 extends between the lower end 88 (and lower retaining wall 92) and the upper end 90 (and upper retaining wall 94) of the self-energizing seal 70. Each rib 96 includes a frictional outwardly facing surface 98 shaped and dimensioned to engage the inner wall 64 of the wine bottle 16. Connecting the outwardly facing surface 98 of each rib 96 to the base structure of the connecting seal assembly 54 are an upper sidewall 100 (which forms part of the upper retaining wall 94), a lower sidewall 102 (which forms part of the lower retaining wall 92), a first lateral sidewall 104 and a second lateral sidewall 106.

The outwardly facing surface 98, upper sidewall 100, lower sidewall 102, first lateral sidewall 104, second lateral sidewall 106 and base structure of the self-energizing seal 70 define the shape of the cavity 156 that is exposed to the internal pressure applied to the wine bottle 16 via the pressure of the argon feeding into the cavity 156 via the aperture 158 in the substrate 86 as discussed above. The application of argon gas pressure causes outward expansion of the respective ribs 96. This outward expansion, in conjunction with the pressurized argon gas being applied to the internal cavity 156 of the self-energizing seal 70, causes the outwardly facing surface 98 of the ribs 96 to engage the inner wall 64 of the bottle neck.

As a result, when the argon gas pressure is applied within the wine bottle 16, the pressurized argon gas causes the outwardly facing surface 98 to bow outwardly and into secure contact with the inner wall 64 of the wine bottle 16. In addition, when the argon is applied to the wine bottle through the nozzle, pressurized argon is forced into the cavity 156 defined by the self-energizing seal 70 to expand the self-energizing seal 70 and force it into contact with the inner wall 64 of the bottle opening 43. Because of this construction, as greater pressure is applied within the bottle, the outwardly facing surface 98 is forced further outward creating greater pressure between the ribs 96 and the inner wall 64 of the wine bottle 16.

The ribs 96 will also push out proportional to the gas pressure applied to the upper surface 44 of the wine 46 in a manner counteracting the force of the gas trying to push the dispensing nozzle 42 out of the bottle opening 43. The argon gas held behind the self-energizing seal 70 needs to be contained so the seal at the upper end 90 of the self-energizing seal 70 is important to keep gas from escaping. The retaining ribs 96 are provided to keep the self-energizing seal 70 extended and in position when pushing the dispensing nozzle 42 into the bottle opening 43. The gap between the self energizing seal 70 and substrate 86 is important to allow a gas space, that is, the previously discussed cavity 156, as well as a collapse area for the self-energizing seal 70 on smaller diameter bottles.

Through the application of the self-energizing seal 70, a seal arrangement is provided which accommodates variations in wine bottle size openings, allows for reuse of the dispensing nozzle without fully replacing the seal, and ultimately increases the flavor of the wine over time. In accordance with a preferred embodiment, the connecting seal assembly 54 is shaped and dimensioned to accommodate wine bottle openings 43 ranging in size from approximately 17.25 mm to 19.5 mm.

In accordance with a preferred embodiment of the present invention, the self-energizing seal 70 is a distinct member secured about a downwardly extending substrate 86 of the connecting seal assembly 54 to create the connecting seal assembly 54. However, those skilled in the art will appreciate they may be integrally molded without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A dispensing apparatus, comprising:

a housing having a support platform shaped and dimensioned for supporting at least one bottle may be supported;

a pressurized gas supply assembly for forcing a fluid from the at least one bottle; the pressurized gas supply assembly includes an inert gas output which is linked to the at least one bottle via a conduit arrangement and a dispensing nozzle selectively secured within an opening of the at least one bottle;

the dispensing nozzle including a connecting seal assembly for attaching the dispensing nozzle within the opening of the a least one bottle, the connection seal assembly extends downwardly and substantially covers a downwardly extending substrate of the dispensing nozzle, and the connecting seal assembly includes a self-energizing seal;

wherein the self energizing seal is cylindrical and includes an outer wall shaped and dimensioned to engage an inner wall of the opening of the at least one bottle, the self-energizing seal also includes an inner wall having a central portion which is spaced from an outer surface of the downwardly extending substrate of the dispensing nozzle and defines, in conjunction with the outer surface to the downwardly extending substrate of the dispensing nozzle, a cavity which is in communication with the pressurized gas supply assembly for expanding the self-energizing seal and forcing the self energizing seal into contact with an inner wall of the opening of the at least one bottle.

2. The dispensing apparatus according to claim 1, wherein an aperture is formed in the downwardly extending substrate of the dispensing nozzle allowing for free flow of gas therethrough.

3. The dispensing apparatus according to claim 2, wherein a compression coupling member secures the self-energizing seal in position about the downwardly extending substrate of the dispensing nozzle.

4. The dispensing apparatus according to claim 3, wherein the downwardly extending substrate includes a retaining recess shaped and dimensioned for receiving an inwardly directed flange at a first end of the self-energizing seal.

5. The dispensing apparatus according to claim 4, wherein the self-energizing seal includes the first end positioned adjacent a first end of the downwardly extending substrate and a second end positioned adjacent a second end of the downwardly extending substrate, the self-energizing seal further including a circumferential, lower retaining wall adjacent die first end of the self-energizing seal and a circumferential, upper retaining wall adjacent the second end of the self-energizing seal with a plurality of hollow outwardly extending ribs extending therebetween.

* * * * *